US006093016A

United States Patent [19]

Lin

[11] Patent Number: 6,093,016

[45] Date of Patent: Jul. 25, 2000

[54] CIGARETTE LIGHTER IN THE SHAPE OF A STATUE

[76] Inventor: LiYu Lin, 32-40 60th St., Woodside, N.Y. 11377

[21] Appl. No.: 09/227,052

[22] Filed: Jan. 7, 1999

[51] Int. Cl.[7] ..... F23Q 2/32

[52] U.S. Cl. ..... 431/125; 431/255

[58] Field of Search ..... 431/125, 255, 431/126

[56] References Cited

U.S. PATENT DOCUMENTS

| | | | |
|---|---|---|---|
| D. 147,323 | 8/1947 | Erlanger | D48/27 |
| D. 155,468 | 10/1949 | Weston | D48/27 |
| D. 158,706 | 5/1950 | Zaima et al. | D48/27 |
| D. 208,573 | 9/1967 | Rappoport | D48/27 |
| D. 290,525 | 6/1987 | Ichikawa | D27/41 |
| D. 291,369 | 8/1987 | Ichikawa | D27/41 |
| D. 320,284 | 9/1991 | Peersmann | D27/148 |
| D. 338,738 | 8/1993 | Mannella et al. | D27/148 |
| D. 358,681 | 5/1995 | Toombs | D27/148 |
| 2,493,081 | 1/1950 | Negbaur | 67/4.1 |
| 2,503,587 | 4/1950 | Murphy | 67/27 |
| 4,292,021 | 9/1981 | Miyagawa | 431/255 |
| 4,340,356 | 7/1982 | Racek | 431/254 |
| 4,522,583 | 6/1985 | Kraser | 431/125 |
| 4,880,377 | 11/1989 | Ficho | 431/126 |
| 4,948,361 | 8/1990 | Wu | 431/125 |
| 5,226,810 | 7/1993 | Novinsky | 431/125 |
| 5,865,614 | 2/1999 | Hsu | 431/255 |

*Primary Examiner*—Carroll Dority
*Attorney, Agent, or Firm*—Steven Horowitz

[57] ABSTRACT

A portable cigarette lighter in the form of a statute of a human figure holding a torch high at the end of one outstretched hand and holding an object in the other hand, such as the statute of liberty adorning New York harbor, includes a hollow housing in the form of a human which houses a fluid storage cylinder and an associated valve that controls release of fluid from the cylinder to a fluid outlet rod that extends from the cylinder to the torch and transports fluid to the torch via the rod. A spring loaded rocker arm whose upward rotating is limited by the housing and which can be depressed downward to activate the lighter includes the hand holding an object and extends into the housing where it fastens to a pivot around which it rotates. Pushing the hand holding the object causes the rocker arm to rotate downward into an actuating cam that depresses a piston linked that opens the fluid discharge valve. Means known in the art, such as sending a spark to the end of a wire adjacent the rod in the torch, simultaneously ignites the fluid in the torch to cause a flame to extend out of the torch through an aperture.

5 Claims, 3 Drawing Sheets

CIGARETTE LIGHTER IN THE SHAPE OF A STATUE

BACKGROUND AND SUMMARY OF THE INVENTION

The present invention relates to a lighter, such as a cigarette lighter, in the form of a statute.

There are numerous cigarette lighters in various shapes and forms for amusement purposes. Examples include U.S. Pat. Nos. 2,493,081, 2,503,587, 4,948,361, 5,226,810, 4,522,583, 4,340,356, 4,880,377 as well as design Pat. Nos. Des. 291,369, Des. 310,888, Des. 290,525, Des. 158,706, Des. 208,573, Des. 155,468, Des. 358,681 and Des. 320, 284.

One important object and advantage of the present invention is to provide the combination of a functioning cigarette and one that is in the form of human statute thereby providing amusement.

Another object is to provide a lighter in the form of a human figure that is activated by pushing a hand that causes a torch held in the other hand/arm to light up.

Another object and advantage is to provide a lighter that is in the shape of the Statute of Liberty located in New York City's harbor wherein the torch of the statute provides the source of the flame and wherein the lighter is turned on by pushing the hand of the statute holding the object (not the hand of the arm holding the torch).

The above and other objects and features of the present invention will become more apparent from the following detailed description in connection with the following drawings.

DETAILED DESCRIPTION OF THE DRAWINGS

Figure 1:
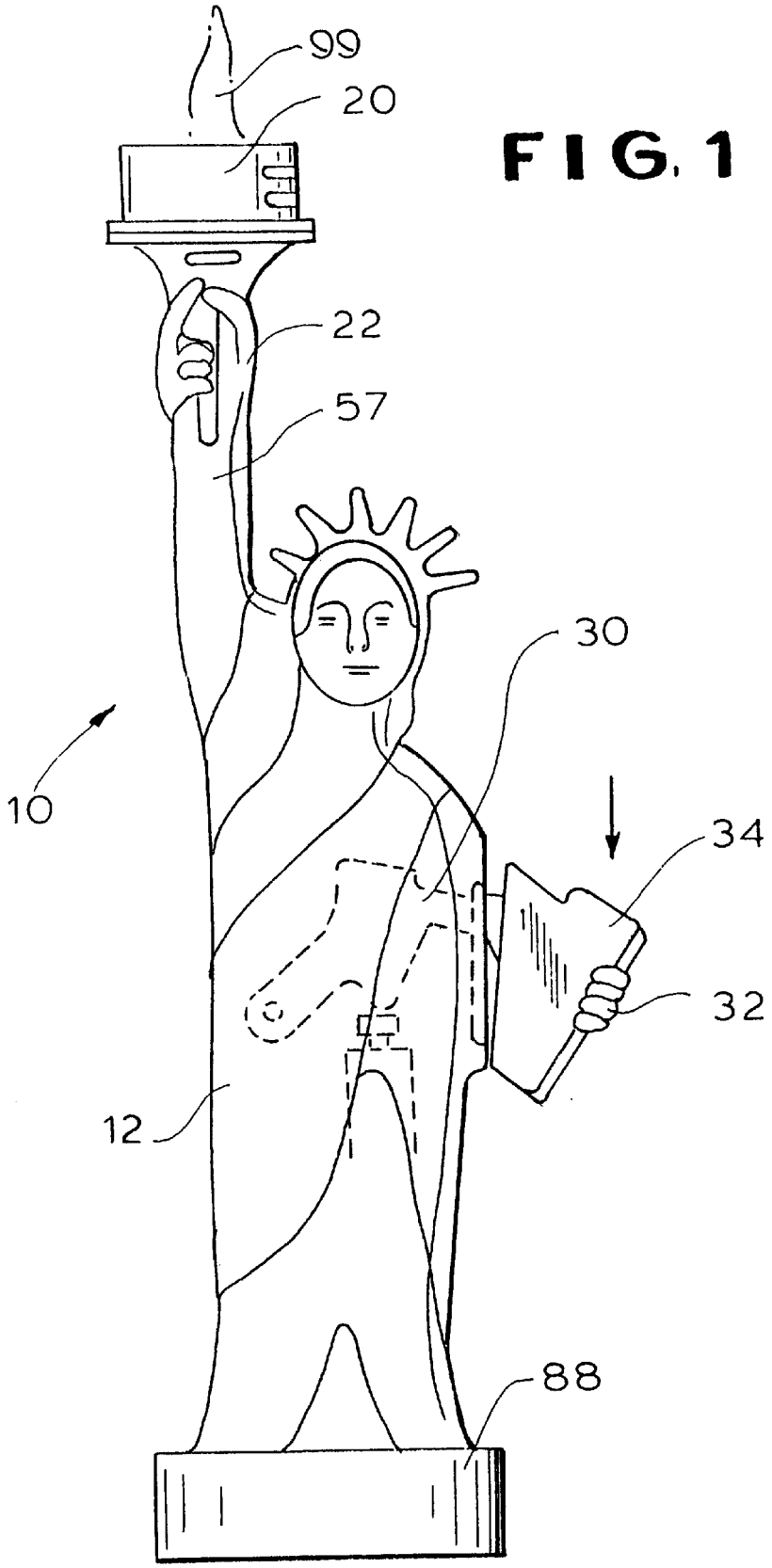
FIG. 1 shows a front view of the outer appearance of the cigarette lighter of the present invention.
Figure 2:
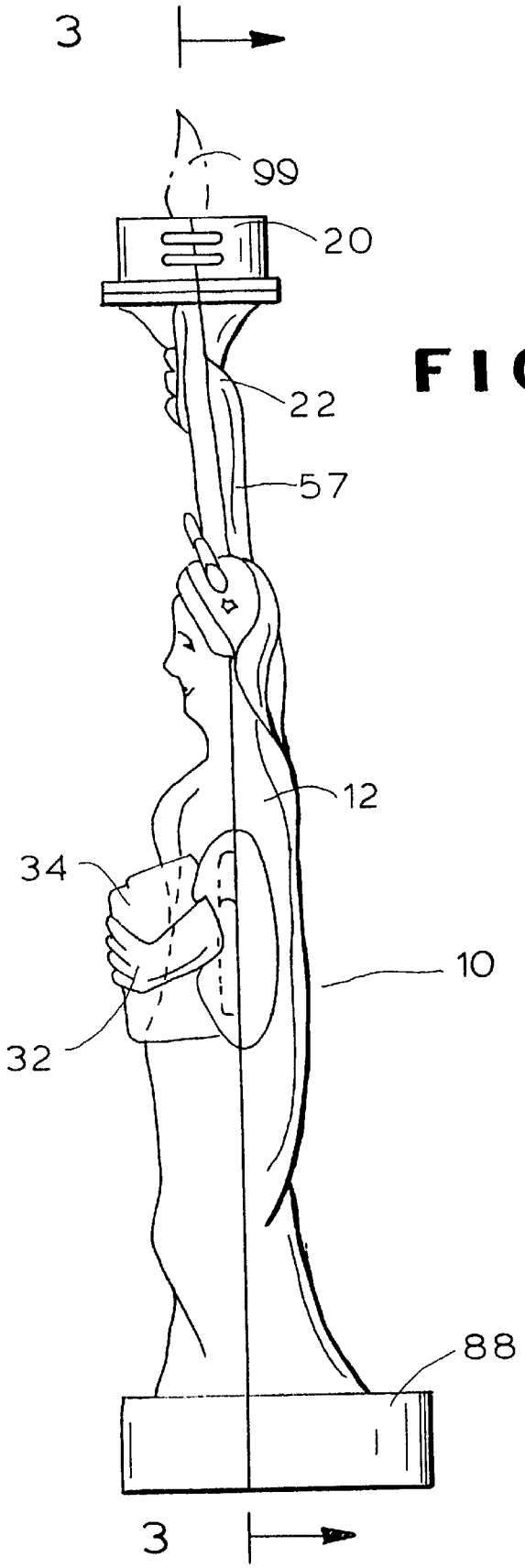
FIG. 2 shows a side view of the outer appearance of the cigarette lighter of the present invention.
Figure 3:
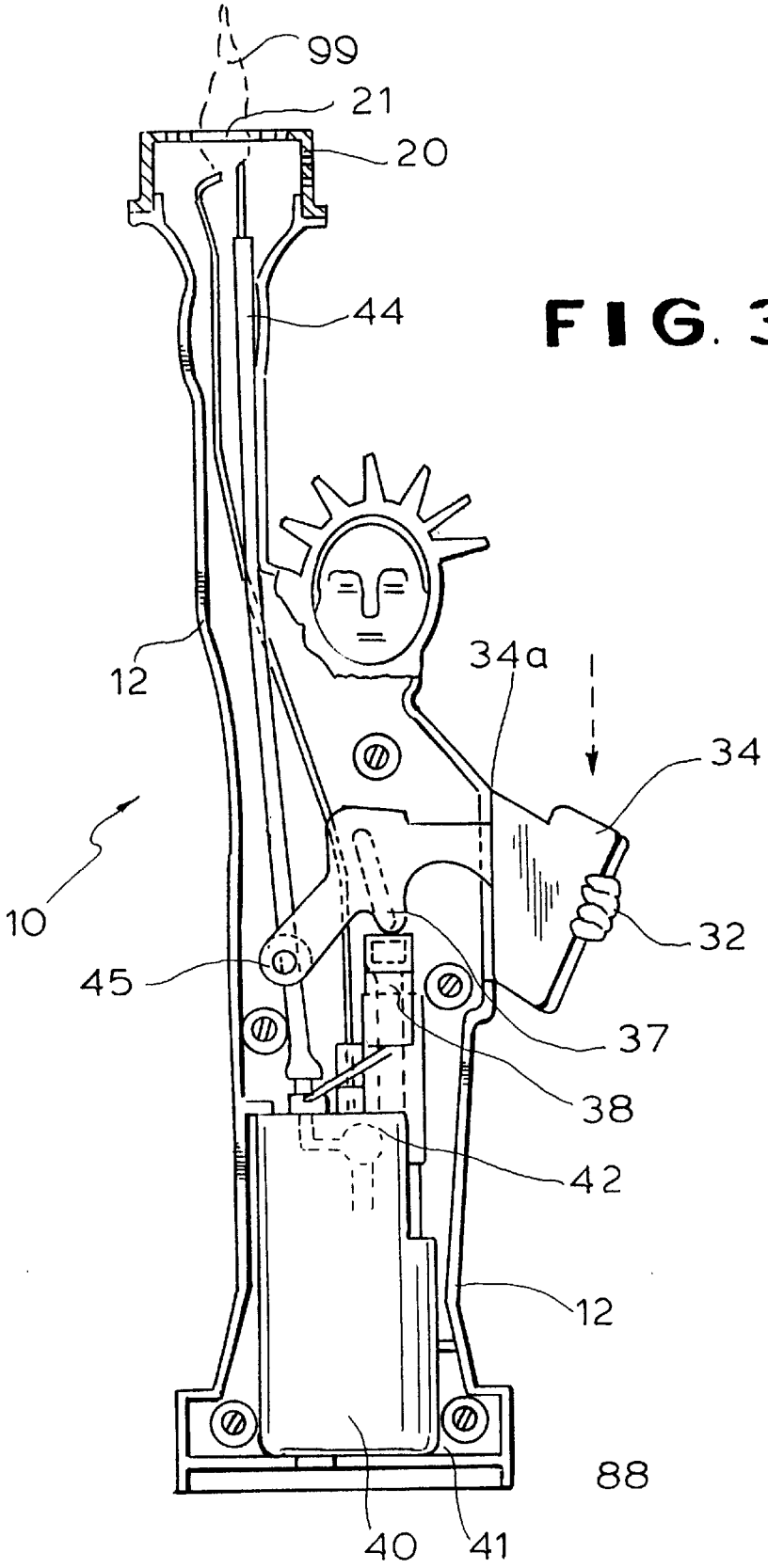
FIG. 3 shows a vertical cross-sectional view of the cigarette lighter of the present invention taken along line 3—3 of FIG. 2 with the head partially broken away.

As seen from FIGS. 1–3, portable cigarette lighter 10 is in the form of a statute of a human figure having hollow housing 12 in the form of a human. Housing 12 also functions as an outer housing for lighter 10. The entire lighter 10 is typically of a size that can be held in one hand, although the present invention is not limited to a particular size and it is contemplated that it can be larger or smaller. Housing 12 includes an outstretched arm 57 holding torch 20 typically in hand 22 and includes another hand 32 holding an object 34. Lighter 10 has a fluid storage cylinder 40 at the foot end 41 of housing 12 or on flat base 88. The fluid may be gas or liquid.

Preferably, housing 12 sits on or includes a flat base 88 so that lighter 10 can be placed comfortably on the top surface of an object, such as furniture.

It should be noted that fluid storage cylinder 40 is only one means known in the prior art that is used to generate a flame 99 in torch 20. It is contemplated by the present invention that any other means can be used.

Fluid storage cylinder 40 has associated with it and which may be inside it a fluid discharge valve 42 that when activated allows fluid to be discharged from cylinder 40 to a fluid outlet rod 44 that extends from cylinder 40 to torch 20. Torch 20 has an aperture 21 through which flame 99 can flare and be seen and used when the entire lighter 10 is closed by housing 12.

In FIG. 3, fluid discharge valve 42 is shown in dashed lines inside cylinder 40.

A rocker arm 30, which includes hand 32 sticking out of housing 12, which hand 32 may be holding an object 34, extends into the housing 12 and fastens to the inside of housing 12 at a pivot 45 around which rocker arm 30 rotates. Hand 32 is visible even when housing 12 covers lighter 10. Accordingly, the act of pushing or pressing hand 32 downward relative to housing 12, which hand 32 is part of rocker arm 30, causes the fluid discharge valve 42 to open. This occurs because the rotation of rocker arm 30 opens valve 42.

Rocker arm 30 is spring loaded by spring 31 so that it is kept in an "up" position until pressed. Rocker arm 30 cannot rotate further upward because an upper part 34*a* of object 34 is adjacent housing 12. Rocker arm 30 is also captured by the shape of housing 12 from moving horizontally.

When rocker arm 30 rotates downward rocker arm 30 causes actuating cam 37 to depress a small piston 38 linked to valve 42 to open valve 42 when the piston 38 is depressed. Fluid discharge valve 42 can also be opened by any other suitable means. In any case, opening the fluid discharge valve 42 causes fluid to be discharged from the fluid storage cylinder 40 past the fluid discharge valve 42 into and through fluid outlet rod 44 and to the torch 20.

Any means well known in the art may be used to combine with the discharge of the fluid in the torch 20 to generate flame 99. For example, means well known in the art can be used to generate a spark at the free upper end 72 of a wire 72 extending into torch 20 near the top end of rod 44 where fluid is simultaneously being discharged from. The spark ignites flame 99 in torch 20.

Flame 99 is large enough that it extends visibly through aperture 21 to a point outside housing 12 and can be used to light things.

In sum, pushing the hand 32 of rocker arm 30 causes a flame 99 to project out of torch 20 of lighter 10.

It is to be understood that while the apparatus of this invention have been described and illustrated in detail, the above-described embodiments are simply illustrative of the principles of the invention. Various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A portable cigarette lighter in the form of a human figure, comprising:

a hollow housing in the form of a human that encloses the lighter, said housing including an outstretched arm holding a torch and a hand holding an object, said torch having an aperture for exposing a flame, a fluid storage cylinder located inside the housing at a foot end thereof and having a fluid discharge valve associated therewith, a fluid outlet rod inside the housing extending from the fluid storage cylinder to the torch, a rocker arm including said hand sticking out of and limited by the housing, said rocker arm being spring loaded by a spring and extending into the inside of the housing and fastening therein to a pivot that allows said rocker arm to rotate, said rocker arm when depressed also causing an actuating cam to depress a piston thereby opening the fluid discharge valve and releasing fluid to the torch through the rod, said rocker arm springing back to an original position when the hand is released, means for igniting the fluid and generating a flame in the torch when the rocker arm is rotated, said flame extending visibly through the aperture to a point outside the housing.

2. The cigarette lighter of claim 1, wherein the housing rests on a flat base so that the lighter can be placed comfortably on a flat surface.

3. The cigarette lighter of claim 1, wherein the outstretched arm has a hand holding the torch.

4. The cigarette lighter of claim 1, wherein the means to ignite the fluid includes the generating of a spark at a free upper end of a wire adjacent the rod in the torch.

5. The cigarette lighter of claim 1, wherein the means to ignite the fluid includes the generating of a spark at a free upper end of a wire adjacent the rod in the torch, wherein the outstreched arm has a hand holding the torch and wherein the housing rests on a flat base so that the lighter can be placed comfortably on a flat surface.

* * * * *